US011214406B2

(12) United States Patent
Kluenenberg et al.

(10) Patent No.: US 11,214,406 B2
(45) Date of Patent: Jan. 4, 2022

(54) UNFILLED OPEN SIDE-GUSSET BAG

(71) Applicants: Bjoern Kluenenberg, Damme (DE); Tobias Buck, Damme (DE)

(72) Inventors: Bjoern Kluenenberg, Damme (DE); Tobias Buck, Damme (DE)

(73) Assignee: MONDI AG, Vienna (AT)

( * ) Notice: Subject to any disclaimer, the term of this patent is extended or adjusted under 35 U.S.C. 154(b) by 41 days.

(21) Appl. No.: 16/660,151

(22) Filed: Oct. 22, 2019

(65) Prior Publication Data

US 2020/0130896 A1 Apr. 30, 2020

(30) Foreign Application Priority Data

Oct. 24, 2018 (EP) ..... 18202406

(51) Int. Cl.

| | |
|---|---|
| ***B65D 33/08*** | (2006.01) |
| ***B65D 30/20*** | (2006.01) |
| ***B65D 30/08*** | (2006.01) |
| ***B65D 33/25*** | (2006.01) |

(52) U.S. Cl.

CPC ..... *B65D 31/10* (2013.01); *B65D 31/02* (2013.01); *B65D 33/08* (2013.01); *B65D 33/2591* (2013.01)

(58) Field of Classification Search

CPC ..... B65D 31/10; B65D 31/02; B65D 33/08; B65D 33/2591

USPC ..... 383/7

See application file for complete search history.

(56) References Cited

U.S. PATENT DOCUMENTS

| | | | | |
|---|---|---|---|---|
| 5,060,803 | A * | 10/1991 | Beer | B65D 77/12 383/200 |
| 6,375,037 | B1 * | 4/2002 | Bell | B65D 75/008 206/439 |
| 7,210,848 | B2 | 5/2007 | Barbier | |
| 7,331,917 | B2 | 2/2008 | Totani | |
| 8,944,684 | B2 | 2/2015 | Bell | |
| 10,183,796 | B2 | 1/2019 | Kruse | |
| 10,486,881 | B2 * | 11/2019 | Wigman | B65D 77/225 |
| 2004/0120613 | A1 * | 6/2004 | Hanson | B65D 31/10 383/120 |
| 2008/0240626 | A1 * | 10/2008 | Bell | B65D 31/10 383/120 |

(Continued)

FOREIGN PATENT DOCUMENTS

| | | | |
|---|---|---|---|
| DE | 10340099 | A | 3/2005 |
| DE | 102008021505 | A | 11/2009 |
| EP | 2857323 | A | 4/2015 |

(Continued)

*Primary Examiner* — Peter N Helvey

(74) *Attorney, Agent, or Firm* — Andrew Wilford

(57) ABSTRACT

A bag has two face panels having upper and lower transversely extending end edges and longitudinally extending side edges between outer ends of the end edges, two side gussets each between a respective one of the side edges of one of the face panel and the respective side edge of the other face panel, and a base panel having a peripheral edge connected to the lower edges of the face panels and gussets. The panels and gussets form beveled or rounded corners at upper ends of the side edges. Respective corner welds at the corners each extend inward from the respective side edges while leaving the face panels unconnected and forming a filling opening between the corner welds.

15 Claims, 5 Drawing Sheets

(56) References Cited

U.S. PATENT DOCUMENTS

| | | |
|---|---|---|
| 2001/0334608 | 11/2017 | Kruse |

FOREIGN PATENT DOCUMENTS

| | | | |
|---|---|---|---|
| EP | 3023350 | A | 5/2016 |
| JP | 10119905 | B | 5/1998 |
| JP | 2000335595 | B | 12/2000 |
| JP | 2015182769 | B | 10/2015 |

* cited by examiner

UNFILLED OPEN SIDE-GUSSET BAG

FIELD OF THE INVENTION

The present invention relates to a bag. More particularly this invention concerns an unfilled and upwardly open side-gusset bag even after being upwardly closed.

BACKGROUND OF THE INVENTION

Such an unfilled, upwardly open side-gusset bag has two face panels, two side gussets between side edges of the face panels and connecting the face panels, and a stand-up base that is usually embodied as a bottom gusset and between the face panels and joined at its edges by welds to lower edges of the face panels and side gussets.

A stand-up base that is formed as a bottom gusset panel or floor in a flat, unfilled, upwardly open side-gusset bag is almost completely flat when the bag is filled, apart from a central crease, and is attached at a square encircling weld for very good stability of the filled bag when standing on its floor panel.

Diverse film packaging designs that differ substantially in their production are known from practice.

The production of the bag from a film and the packaging of the products and goods to be contained in the bag on the other hand are generally carried out by different companies at different locations.

According to a first approach that is widely used in practice, the upwardly open bag is formed in the packaging process from a prefabricated film tube supplied for that purpose. Such an integrated process is also referred to in practice as an FFS (Form-Fill-Seal) process. It is therefore necessary in the case of such an FFS process to provide a system for making the upwardly open bags as well as an immediately following one for subsequently filling these bags.

On the other hand, the present invention relates to an alternative concept in which initially unfilled, upwardly open side-gusset bags are manufactured and provided by a respective specialized manufacturer so that consumers of such unfilled, open side-gusset bags need only fill them with the desired product and seal or close the upper bag end. This provides the advantage that very simple equipment such as a hopper and a simple welder are sufficient.

Such unfilled, upwardly open side-gusset bags can be formed in a variety of ways, it being possible for resealing devices and other functional elements to also be employed.

Upwardly open side-gusset bags can thus be produced in succession from a continuous material web by folding and welding, so that the production direction of the upwardly open bags then corresponds to the shape of the gussets and thus also to a longitudinal direction of the upwardly open bag. Such a manufacturing process is also referred to as a "longitudinal process." Since only one material web is supplied for the face panels and the side gussets and shaped by suitable folding devices to form a side-gusset tube, process control is relatively simple.

EP 3 023 350 describes a longitudinal process (FIG. 4) and a resulting upwardly open side-gusset bag (FIG. 3). During the manufacturing process, the open head or upper end of the bag can be welded as desired and provided with a weld closure that, in conjunction with appropriate material punching, forms beveled and/or rounded open corners at the open upper end of the bag. The face panels are connected to one another by the formation of a corresponding head seal, it also being possible for a reclosable strip fastener to be at the upper end of the bag and/or just beneath the upwardly open bag end. Such an unfilled, upwardly open side-gusset bag can then be filled from the underside (FIG. 5a). The filled upwardly open side-gusset bag is then sealed by a weld (FIG. 4), whereupon the weld is located in the middle of the floor or bottom panel of the filled upwardly open side-gusset bag (FIG. 1).

Similar upwardly open side-gusset bags are also known from U.S. Pat. No. 7,210,848 and DE 103 40 099.

The described upwardly open side-gusset bags formed by a conventional longitudinal process have the disadvantage of being relatively unstable due to the weld in the middle of the underside.

In order to obtain an upwardly open side-gusset bag with improved stability and even better shape retention, a stand-up base is provided in the generic upwardly open side-gusset bag that is between the face panels and connected at its edges by welds to the face panels and side gussets. Such a stand-up base is usually formed by a bottom gusset that is provided separately and then welded in place during the manufacturing process. In the filled state, the bottom gusset then folds out and forms a substantially flat surface, with especially advantageous stabilization being additionally achieved of the peripheral welds in light of the rectangular shape of the stand-up base in the set-up state.

An upwardly open side-gusset bag of this generic type is known from DE 1 541 332. The successive upwardly open side-gusset bags are produced perpendicular to the course of the side gussets, for which reason such a process is also referred to as a "transverse process."

Another upwardly open side-gusset bag of this generic type that is formed by a transverse process is known from U.S. Pat. No. 7,331,917. As also described therein, a transverse process has the advantage that the side gussets running along a longitudinal side of the upwardly open side-gusset bag can be shortened relative to the face panels, so that a reclosable strip fastener can then be above the side gussets on especially simple manner.

Moreover, it is possible to form a stand-up base by a separate bottom gusset in a longitudinal process as well. Reference is made in this respect to US 2001/0334608, U.S. Pat. No. 10,1783,796, and DE 10 2008 021 505, each of which also discloses prefabricated, unfilled, and upwardly open side-gusset bags of this generic type.

The generic unfilled, upwardly open side-gusset bag with a stand-up base is usually filled at the open upper end of the bag, that is unwelded. It should be noted that a desire exists for the greatest possible simplicity with respect to handling during filling operations. After filling the upwardly open side-gusset bags, usually from a hopper, a tight seal is produced by at least one single transverse weld. As explained previously, it should be kept in mind that maximally simple and reliable process steps are desired during filling.

The different open types have proven their worth in practice and have specific advantages and disadvantages.

OBJECTS OF THE INVENTION

It is therefore an object of the present invention to provide an improved upwardly open side-gusset bag.

Another object is the provision of such an improved upwardly open side-gusset bag that overcomes the above-given disadvantages, in particular where the visual appearance and comfort for a user is achieved without compromising stability and without making filling and sealing more difficult.

SUMMARY OF THE INVENTION

A bag has according to the invention two face panels having upper and lower transversely extending end edges and longitudinally extending side edges between outer ends of the end edges, two side gussets each between a respective one of the side edges of one of the face panel and the respective side edge of the other face panel, and a base panel having a peripheral edge connected to the lower edges of the face panels and gussets. The panels and gussets form beveled or rounded corners at upper ends of the side edges. Respective corner welds at the corners each extend inward from the respective side edges while leaving the face panels unconnected and forming a filling opening between the corner welds.

The beveled and/or rounded open corners impart a particularly high-quality appearance to the upwardly open side-gusset bag. This is especially true when the upwardly open side-gusset bag has a carry handle cutout on the open upper end of the bag that can be formed, for example, in the unconnected region of the face panels through material separation. Such material separation can be achieved through cutting, stamping, or punching.

The beveled and/or rounded open corners also result in better comfort for the user, because sharp corners can be avoided. For example, the risk of "catching" on other objects when the gussets are open or during other handling is also reduced.

According to the present invention, different sealing steps at the open upper end of the bag are usually carried out at different locations and with other equipment. In this regard, the invention is based on the discovery that, in manufacturing unfilled, upwardly open side-gusset bags (prefabricated upwardly open bags) for subsequent filling, even complicated structures and method steps can be easily implemented by specialized manufacturers. For instance, corner welds can even be formed that are adapted to the beveled and/or rounded open corners.

To achieve this, either the shape of the bevel or rounding must be retraced, or a relatively large area must be sealed off with correspondingly high energy input, before the upper bag corners are produced in the desired shape by punching or trimming.

Such complex measures are not desirable during a filling operation with a prefabricated, unfilled, and upwardly open side-gusset bag. The corner welds thus result in relatively complicated and specially adapted sealing structures, with a filling opening still remaining between the corner welds into which a hopper can be inserted, for example.

So while the corner welds are prefabricated as relatively complicated and sophisticated structures, closing can be accomplished by at least one simple transverse weld after filling.

According to a preferred embodiment of the invention, if a carry handle is cut, punched, or stamped on the open upper end of the bag, it is expedient to produce a transverse weld above and another transverse weld below the carry handle. Simple production is possible even then, however, because only straight connecting seams need to be generated.

In principle, the unfilled, upwardly open side-gusset bag can be produced by a transverse process or by a modified longitudinal process in which the bottom gusset is arranged and fastened as a stand-up base in a separate process step.

In order to enable maximally simple manufacturing irrespective of the specific method that is employed, according to a preferred embodiment of the invention the side gussets extend up to the open upper end of the bag and are connected there to the face panels by the corner welds.

In this context, it can also be expedient to fix the gussets to the open upper end of the bag in the folded-in state so that they do not gape there when the upwardly open side-gusset bag is filled. Fixation can be achieved, for example, by adhesive or circular punch-outs in the side gussets (which are initially folded in on themselves), in which case the two face panels are then joined together locally by the upwardly open openings formed in this way during the welding process and particularly during formation of the corner welds and thus fix the side gussets in place as well.

According to a preferred embodiment of the invention, the corner welds each have a first optionally curved leg along the shape of the associated beveled and/or rounded open corner, with a second leg being below the first leg and extending straight in a transverse direction. In a plan view of the flat upwardly open side-gusset bag, the mutually facing ends of the first leg on the one hand and of the second leg on the other hand can be connected by straight transverse welds, so that there is a tight seal and possibly also the impression of a uniform, peripheral weld.

As already described above, a carry handle that is optionally provided can be provided between the ends of the first legs and the ends of the second legs with respect to a open longitudinal direction.

The upwardly open side-gusset bag can be equipped with additional functional elements in the context of the invention. For instance according to an especially preferred embodiment of the invention a reclosable strip fastener is on one of the face panels. The reclosable strip fastener can extend to longitudinal welds where the side gussets are connected to the face panels. Alternatively, such a reclosable strip fastener can also end in front of the side edges of the face panels.

Apart from the optional integration of the reclosable strip fastener in the lateral longitudinal welds, the reclosable strip fastener is exclusively on one of the two face panels, thus enabling the initially unfilled, side-gusset bag to be easily filled via the reclosable strip fastener. The reclosable strip fastener can have two closure strips, for example, each having a detent portion and a connecting lug, it being possible for the interfitting fastener strips to be actuated either manually or with a slider like a zipper.

In order to enable especially simple handling of the upwardly open bag according to the invention after filling, the reclosable strip fastener can be below and at a spacing from the corner welds. This ensures that, even when transverse welds are produced in order to close the upwardly open side-gusset bag at the level of the corner welds, only the two mutually opposing face panels and the adjoining regions of the side gussets need to be welded together. A sufficient spacing between the reclosable strip fastener and the corner welds also means that these conditions exist even in case of manufacturing tolerances during the production of the transverse welds.

Compared to an upwardly open side-gusset bag that is completely open at its upper side, a smaller filling opening is produced in the context of the invention. In order to enable good handling and rapid filling nevertheless, according to a preferred development of the invention the corner welds do not extend beyond the side gussets that are folded in between the face panels along the transverse direction of the upwardly open bag. For example, the corner welds can extend over 50% to 90% of the width of the side gussets folded in half on themselves. At least a portion of the side gussets is then still unconnected in the direction of the filling opening, so that a relatively large filling opening can still be formed there, one with a meaningful dimension perpendicular to the planes of the face panels.

In light of this, the side gussets should be selected so as to be of a suitable size. In particular, the side gussets can be folded in between the face panels along the transverse direction of the upwardly open bag and each extend over 15% to 30% of a width of the face panels in a flat state, so that the spacing between the gussets then corresponds to between 40% and 70% of the width of the face panels.

With the given parameters, it must be taken into account that these relate to the side gussets folded respectively on themselves, with a correspondingly greater depth resulting from the unfolding of the side folds when the upwardly open side-gusset bag is set up.

There are various possibilities for configuring the shape of the upper bag corners. Sharp-edged, right-angled corners can be avoided both by a simple bevel and an arch in the form of a radius. However, geometries consisting of a plurality of curves and/or bevels are preferred. The upper bag corners can be rounded in an S-shape, for example. Especially preferably, this then results in a first convex arch that extends from the upper open edge and, adjacent thereto, a concave arch over to the lateral open edge.

The beveling and/or rounding at the upper bag corners preferably extends in the upwardly open bag longitudinal direction over a length and in the upwardly open bag transverse direction over a width of between 1 cm and 10 cm, preferably between 3 cm and 8 cm.

Typical products for which the upwardly open side-gusset bag is suitable include pelleted pet food, cat litter, powdery or granular construction products, pourable foods, or the like. Particularly when the upwardly open side-gusset bag is provided according to a preferred embodiment of the invention with a reclosable strip fastener, it is possible for some of the contents to be removed, in which case the remaining contents are protected by closing the reclosable strip fastener.

In order to form the welds at the edges of the stand-up base, the longitudinal welds, the corner welds, and subsequently the transverse welds, the upwardly open side-gusset bag is composed of a suitably weldable material. A multilayer film is used usually used in which the inwardly directed face of the film formed by a weldable layer, particularly one based on polyolefin, and an outer layer on the outside of the upwardly open bag will have a higher melting point or be thermosetting.

The inner layer is expediently weldable in order to be able to form and seal the upwardly open side-gusset bag by welding. In addition to polyolefins such as polyethylene (PE), polypropylene (PP) and polyolefin copolymers, various biodegradable plastics such as polylactic acid (PLA), polybutylene adipate terephthalate (PBAT) and polybutylene succinate (PBS) can also be used as weldable material.

The outer layer is less weldable compared to the sealing layer, to which end the outer layer can have a higher melting or softening temperature. When the upwardly open bag film is welded, although the sealing layer is fused, possibly through the outer layers, the outer layer is not excessively deformed or does not its structural integrity. In particular, the outer layer can be made of polyester, particularly polyethylene terephthalate (PET), such an outer layer usually being oriented. Other suitable materials for the outer layer include polyamide, polypropylene, or polylactic acid, these materials also preferably having an orientation caused by a stretching that results in a reduction in the tendency to fuse during welding.

The multilayer bag film is preferably laminated by adhesive. In addition to the sealing layer and the outer layer, it is also possible for additional layers to be provided, for example in order to increase the barrier effect. For example, a film layer of ethylene-vinyl alcohol copolymer (EVOH), a thin metal foil, or a metallized film layer can be provided as a barrier.

The thickness of the face panels, the side gussets, and the stand-up base is usually between 60 μm and 200 μm, preferably between 70 μm and 170 μm. For example, a bag film having an outer layer of PET, a metallized intermediate layer of PET, and a sealing layer of PE, can be provided. The thickness of the two PET layers can be 12 μm, and the thickness of the sealing layer 140 μm, for example. In the context of the described embodiment, each of the three layers can formed as a single film and joined by a laminating adhesive. This is particularly advantageous if an imprint is to be produced between the two PET layers. Starting from the outer layer, an imprint cannot be disposed even farther inward at the transition to the sealing layer due to the metallization.

The filling space preferably has a volume of between 4 l and 20 l, with the filling weight depending on the density of the filling material. In the case of pelleted pet food, the fill weight can be between 2.5 kg and 10 kg, for example. Similar volumes and weights also arise for foods such as rice.

As will readily be understood, the upwardly open side-gusset bag can also be provided for larger or smaller containers.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
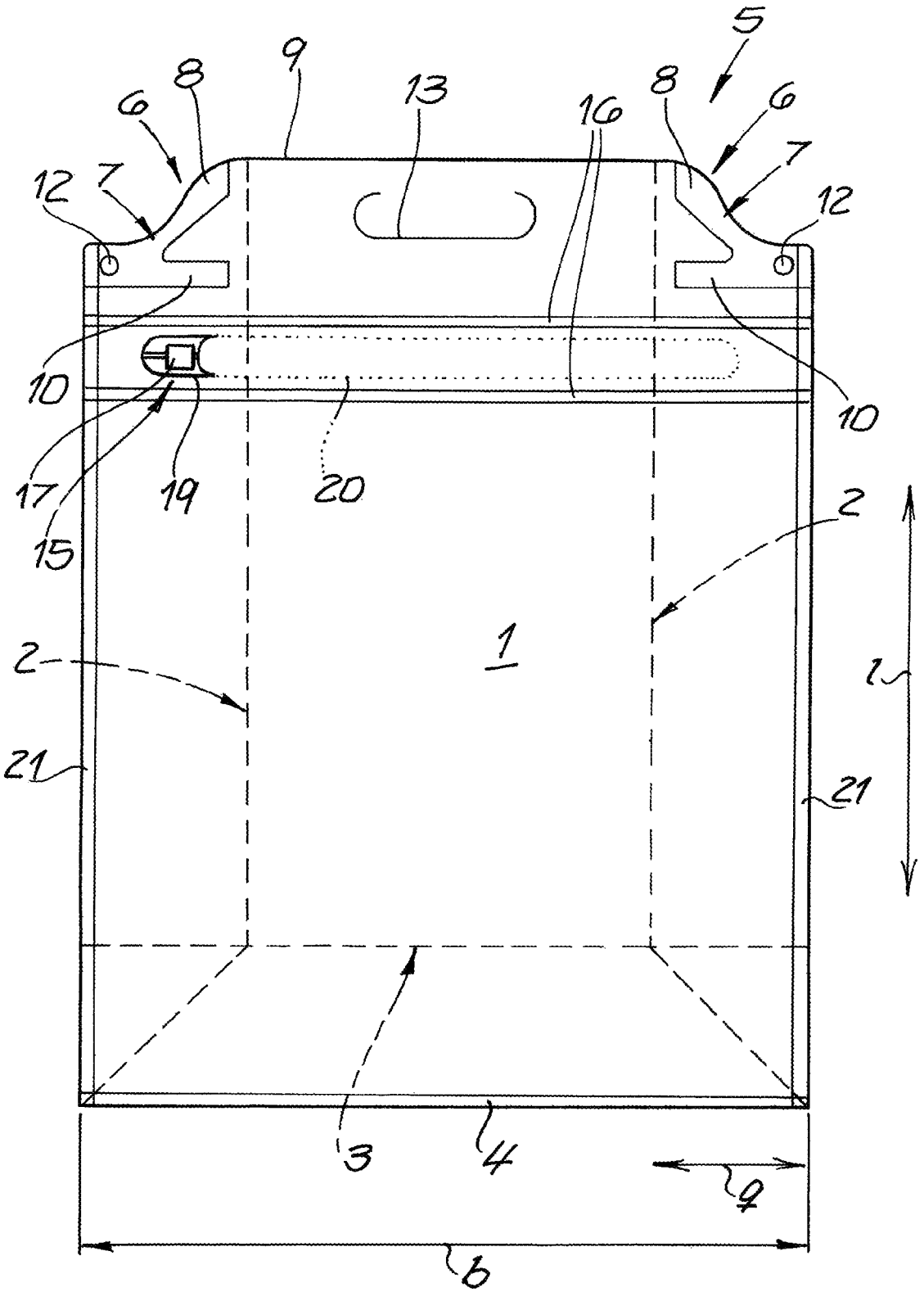
FIG. 1 is a front elevational view of an upwardly open side-gusset bag according to the invention.

FIG. 1 shows an unfilled, upwardly open side-gusset bag in a flattened state that is prefabricated and provided for subsequent filling, usually in a different operation. This prefabricated upwardly open side-gusset bag has two face panels 1 and two side gussets 2 that are between vertical side edges of the face panels 1 and that connect the face panels 1 to one another. A stand-up base panel 3 is formed by a bottom gusset that is initially between the face panels 1, the stand-up base 3 being joined at its outer edges by welds 4 (see FIG. 3) to the lower edges of the face panels 1 and of the side gussets 2.

In the illustrated flat state, the side gussets 2 that are folded in between the face panels 1 extend along a transverse direction q of the upwardly open bag over 15% to 30% of a width b of the face panels along the transverse direction of the upwardly open bag 1.

Open corners 6 that are rounded in an S-shape are provided on a open upper end 5 situated opposite the stand-up base and can be formed by punching or trimming. The side gussets 2 extend along a longitudinal direction l over the entire length or height of the face panels 1, so that the gussets 2 are also trimmed or punched together with the face panels 1 in the desired manner depending on the shape of the upper bag corners 6.

In the region of the upper bag corners 6, the open upper end 5 of the bag 1 has V-shaped corner welds 7. The corner welds 7 each have a first leg 8 that extends along the edge of the respective S-shaped open corner 6. Starting from an upper edge of the upwardly open bag 9, a second leg 10 of each corner weld 7 is disposed beneath the respective first leg 8, the second leg 10 extending in the transverse direction q.

An unwelded region where the two face panels 1 for forming a filling opening 11 (see FIG. 2A) are not connected to each other remains between the adjacent inner ends of the first legs 8 and the second legs 10 of the two corner welds 7.

In the illustrated embodiment, the corner welds 7 do not extend inward past the side gussets 2 in the transverse direction q. The corner welds 7 can each extend over 50% to 90% of the width of the folded-in side gussets 2, for example. If the two face panels 1 are then moved away from one another for filling at the upper edge of the upwardly open bag 9, then the unwelded inner portions of the side gusset panels 2 can also spread open and form a relatively large filling opening 11 despite the corner welds 7.

In order to prevent the side gussets 2 from gaping at the open upper end 5 of the bag 1 upon subsequent filling, the side gussets 2 are fixed in place there by connecting points 12 when folded in.

In the illustrated embodiment, a carry handle 13 is formed by cutting or stamping and is between the inner ends of the first leg 8 on the one hand and inner the ends of the second leg 10 on the other hand relative to the longitudinal direction l. If, as explained below, simple transversely throughgoing welds 14 are formed at the level of the ends (see FIG. 3) of the legs 8 and 10, the carry handle 13 is located between the transverse welds 14 as seen in the longitudinal direction l.

Finally, a reclosable strip fastener 15 is shown in FIG. 1 that is fastened by welds 16 to the front face panel 1 in FIG. 1. In this embodiment, the reclosable strip fastener 15 comprises a slider 17 with which interfitting fastener strip 18 can be separated and connected to form the reclosable strip fastener 15.

Before initial opening, the slider 17 is located in an opening 19 of the associated face panel 1, it being possible for an adjoining portion of the face panel 1 to be torn out along a tear line 20. This tear line 20 can be formed by a perforation, punching, or more preferably by a laser.

In this embodiment, the welds 16 of the reclosable strip fastener 15 extend to longitudinal welds 21 where the vertical side edges of the gussets 2 are connected to the vertical side edges of the face panels 1.

Figure 2A:
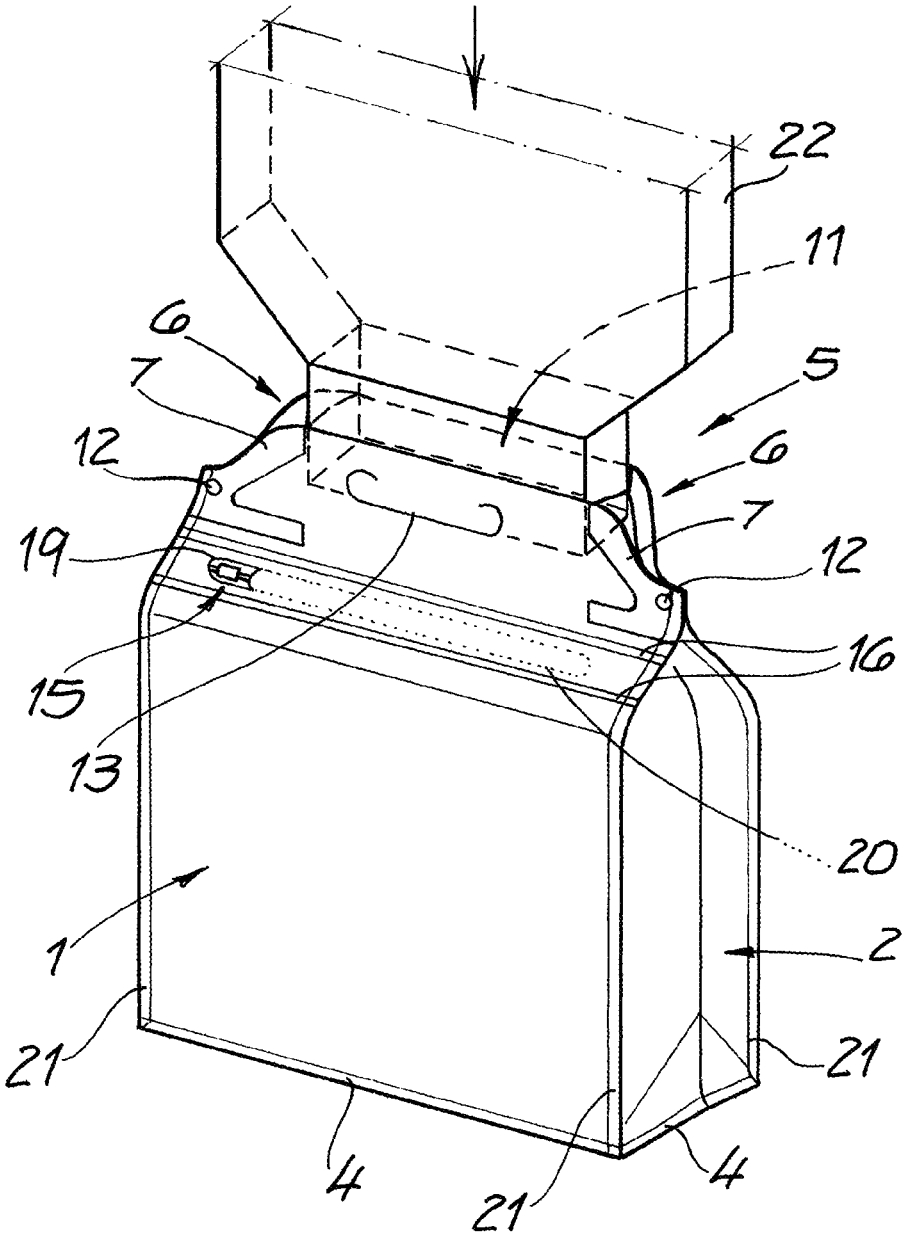
FIG. 2A is a perspective partly schematic view showing the filling process of the initially unfilled, upwardly open side-gusset bag according to FIG. 1.

FIG. 2A shows the initially unfilled, upwardly open side-gusset bag according to FIG. 1 during a filling operation, a hopper 22 being inserted in the filling opening 11. Since the corner welds 7, which are comparatively complicated in shape, are already present in the prefabricated upwardly open side-gusset bag, it can be closed after filling as shown in FIG. 2A in an inherently known manner by simple, straight transverse welds 14 (See FIG. 2B), the transverse welds 14 connecting the corner welds 7 to one another.

Figure 2B:
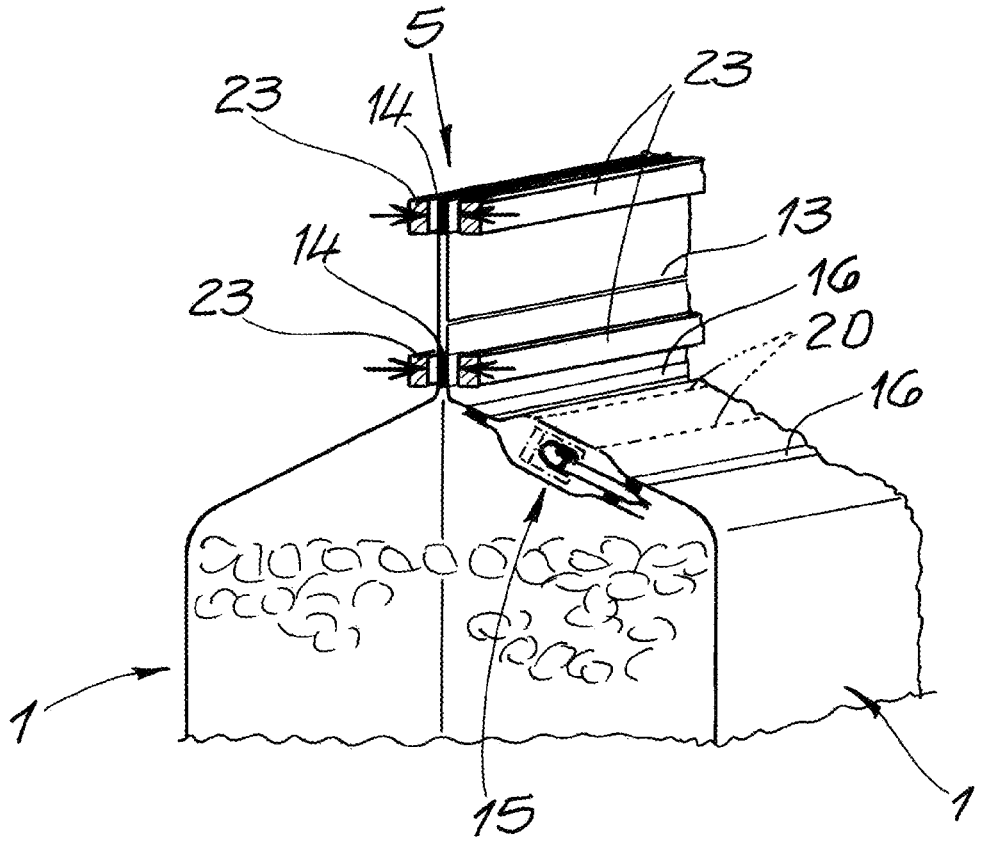
FIG. 2B is a large-scale view like FIG. 2A showing the closure of the upwardly open side-gusset bag filled according to FIG. 2A.

In the illustrated embodiment, a transverse welds 14 are produced above and below the carry handle 13 in the upwardly open side-gusset bag. Since the transverse welds 14 extend to the corner welds 7, a closed frame is thus formed around the carry handle 13, thus ensuring that the filled upwardly open side-gusset bag is also tightly sealed. Conventional straight welding jaws 23 shown schematically in FIG. 2B are used to make these welds 14.

Figure 3:
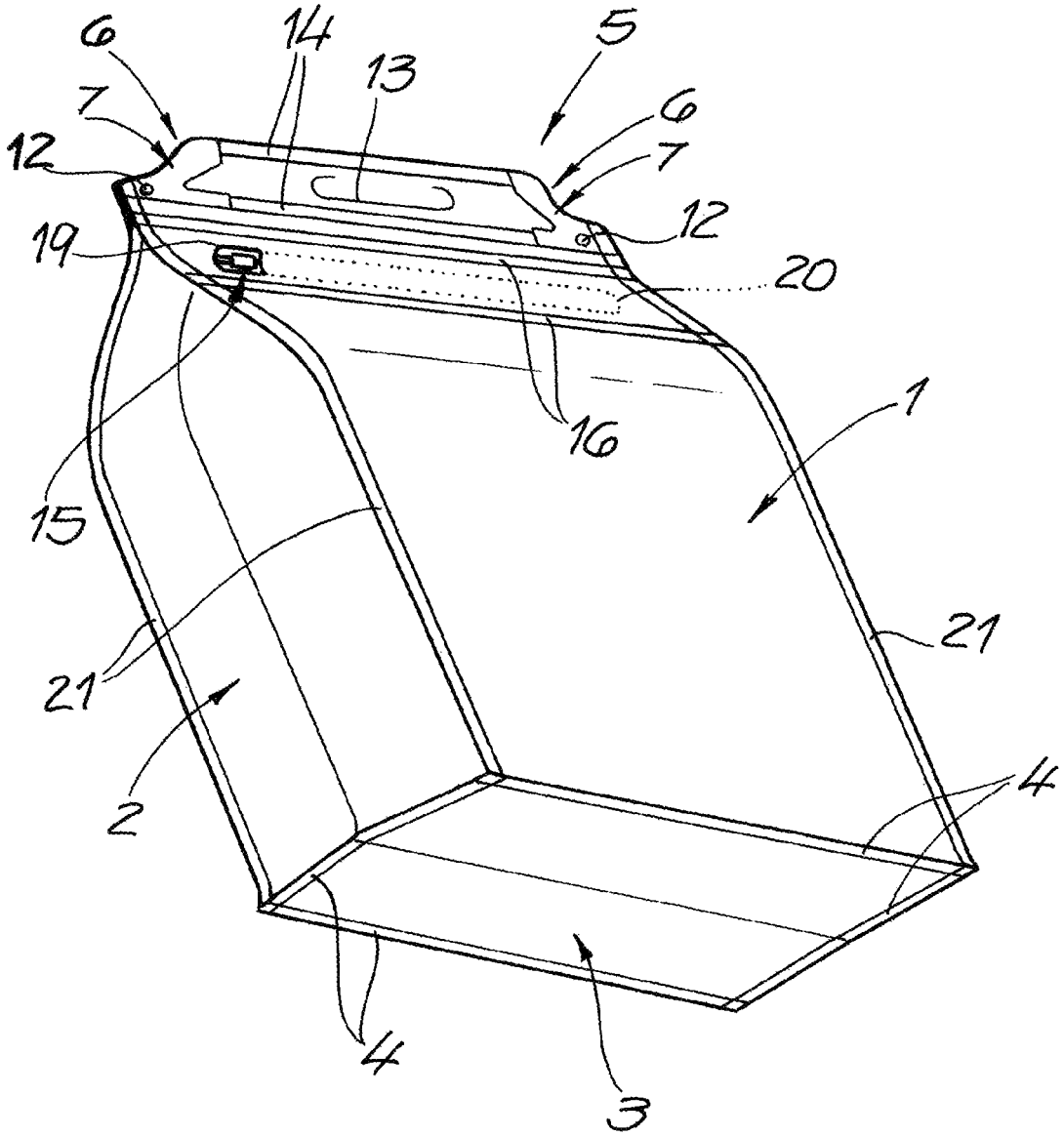
FIG. 3 is a perspective view from below of the filled upwardly open side-gusset bag.

Finally, FIG. 3 shows the filled upwardly open side-gusset bag in a perspective view from below.

Figure 4:
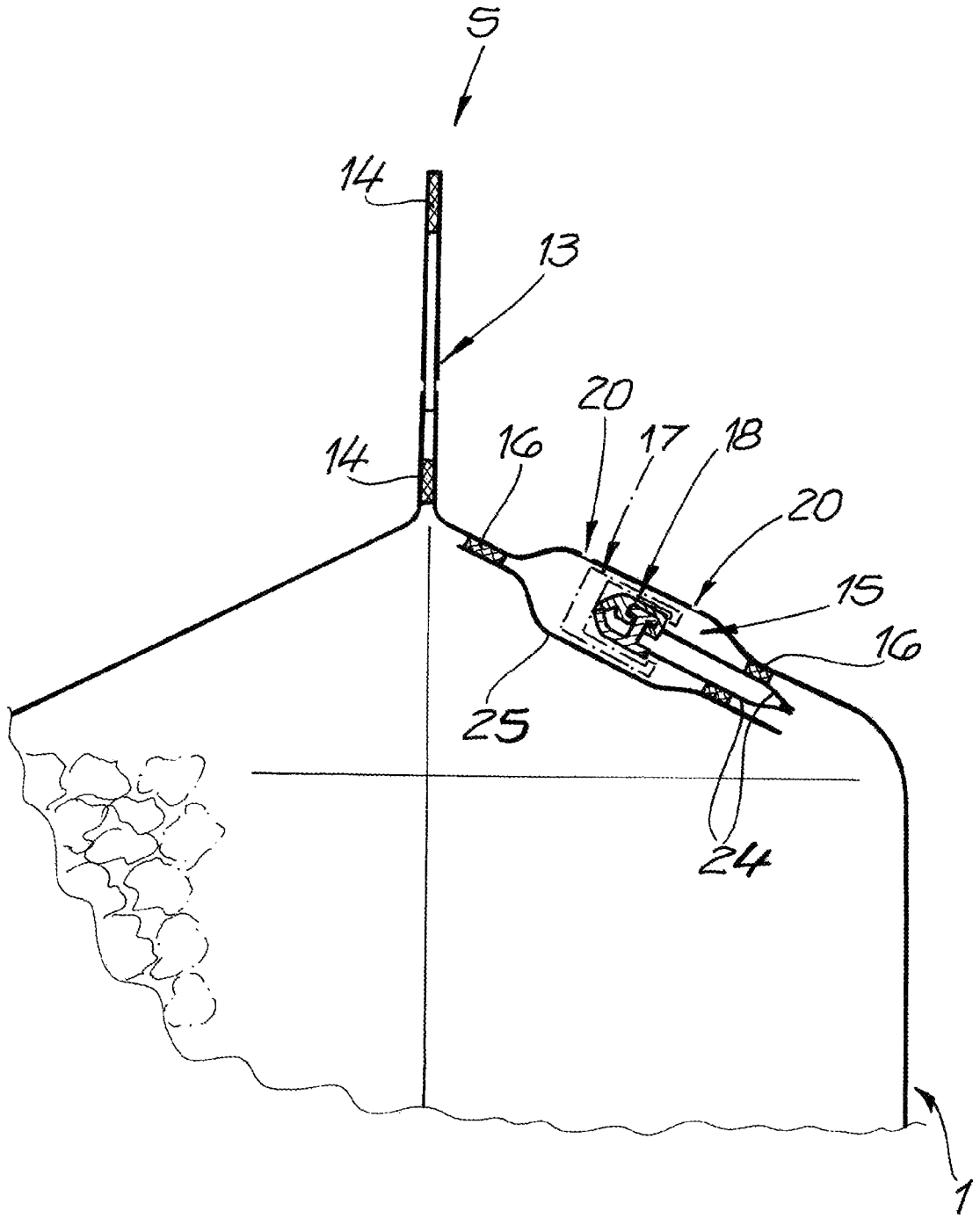
FIG. 4 is a large-scale vertical a section through an upper end of the upwardly open side-gusset bag according to FIG. 3.

A preferred embodiment of the reclosable strip fastener 15 is shown in FIG. 4. It has a slider 17 that acts on the interfitting fastener strips 18. A respective connecting lugs 24 extend from the interfitting fastener strips 18, the rear connecting lug 24 being fastened to a separate film strip 25 inside the slider 17 and covering the interfitting fastener strips 18 starting from the associated face panel 1. Since the two connecting lugs 24 are initially connected to one another, a tight seal is ensured before initial opening even though, according to FIG. 1, the slider 17 is in an opening 19.

Moreover, it can also be seen that the entire reclosable strip fastener 15, including the film strip 25, is below and at a spacing from the corner welds 7 and the lower transverse weld 14.

We claim:

1. A bag comprising:

two face panels having upper and lower transversely extending end edges and longitudinally extending side edges between outer ends of the end edges;

two side gussets each between a respective one of the side edges of one of the face panels and the respective side edge of the other face panel, the panels and gussets forming beveled or rounded corners at upper ends of the side edges;

a base panel having a peripheral edge connected to lower edges of the face panels and gussets; and respective corner welds at the corners and each extending inward from the respective side edges over 50% to 90% of the width of the side gussets folded in half on themselves, the corner welds and each having a first leg extending along an edge of the respective corner and a second leg therebelow projecting transversely inward from the respective side edge while leaving the face panels unconnected and forming a filling opening between the corner welds.

2. The bag according to claim 1, wherein the side gussets extend to the open upper edges of the face panels and are connected there by the corner welds to the face panels.

3. The bag according to claim 1, wherein corner welds each have a first leg extending along an edge of the respective corner and a second leg therebelow projecting transversely inward from the respective side edge.

4. The bag according to claim 3, wherein the face panels are formed at the upper end with a carry handle cutout.

5. The bag according to claim 4, wherein the carry handle cutout is generally longitudinally below inner ends of the first legs and above inner ends of the second legs.

6. The bag according to claim 1, further comprising:

a reclosable strip fastener extending transversely in one of the face panels.

7. The bag according to claim 1, wherein the reclosable strip fastener is below the corner welds.

8. The bag according to claim 1, wherein, in a flattened condition of the bag, the corner welds do not extend transversely inward from the respective side edges past the respective gussets.

9. The bag according to claim 1, wherein the corner welds secure together front panels to the gusset and fix the gussets in a folded-together condition, whereby each corner weld fixes together four layers or a film from which the bag is made.

10. The bag according to claim 1, wherein in a flattened condition of the bag the side gussets extend inward from the respective side edges by between 15% and 30% of a transverse width of the bag between the side edges thereof.

11. The bag according to claim 1, wherein the corners each have an S-shaped outer edge.

12. The bag according to claim 1 wherein the corner welds each extend longitudinally and transversely of the bag over 3 cm to 8 cm.

13. A bag comprising in a flattened condition:

two face panels having upper and lower transversely extending end edges and longitudinally extending side edges between outer ends of the end edges and lying flatly against each other in at least a central region;

two side gussets each folded and lying between a respective one of the side edges of one of the face panel and the respective side edge of the other face panel, the panels and gussets forming beveled or rounded corners at upper ends of the side edges;

a base panel folded inward between the face panels and having a peripheral edge connected to the lower edges of the face panels and gussets; and respective corner welds at the corners and each extending inward from the respective edges over 50% to 90% of the width of the side gussets folded in half on themselves, the corner welds and each having a first leg extending along an edge of the respective corner and a second leg therebelow projecting transversely inward from the respective side edge while leaving the face panels unconnected and forming a filling opening between the corner welds, the corner welds fixing together the face panels and portions of the side gussets therebetween such that the side gussets cannot unfold at the corner welds.

14. The bag according to claim 13, wherein each of the welds secures the respective front panel to a respective half of the respective gusset.

15. The bag according to claim 13 wherein one of the legs of each corner weld extends along the respective beveled or rounded corner and the other of the legs extending straight and perpendicular from the respective side edge.

* * * * *